United States Patent [19]

Fletcher

[11] Patent Number: 4,916,921

[45] Date of Patent: Apr. 17, 1990

[54] ICE MAKER WITH VERTICAL COOLING MEMBER

[76] Inventor: Charles J. Fletcher, 7 Valley Rd., Sparta, N.J. 07871

[21] Appl. No.: 325,741

[22] Filed: Mar. 20, 1989

Related U.S. Application Data

[62] Division of Ser. No. 95,805, Sep. 10, 1987, Pat. No. 4,831,840.

[51] Int. Cl.[4] ..... F25C 1/24

[52] U.S. Cl. ..... 62/356; 62/443; 312/312

[58] Field of Search ..... 62/443, 125, 457.9, 62/356; 229/123.1; 249/121, 127; 312/319, 333, 312; 340/570

[56] References Cited

U.S. PATENT DOCUMENTS

| | | | |
|---|---|---|---|
| 527,589 | 10/1894 | Bristol | 340/570 |
| 758,039 | 4/1904 | Andrews | 312/319 |
| 1,758,073 | 5/1930 | Davenport | 62/443 |
| 1,759,513 | 5/1930 | Litle, Jr. | 62/443 X |
| 1,775,989 | 9/1930 | Dennison | 62/443 X |
| 1,820,134 | 8/1931 | Geyer . | |
| 1,824,308 | 9/1931 | Storer . | |
| 2,015,496 | 9/1935 | Platt . | |
| 2,033,554 | 3/1936 | Smith | 62/443 X |
| 2,257,925 | 10/1941 | Vretman | 62/443 X |
| 2,478,312 | 8/1949 | Peltier | 62/356 |
| 2,736,656 | 2/1956 | Marshall | 229/123.1 |
| 2,955,044 | 10/1960 | Tupper | 249/121 |
| 2,964,920 | 12/1960 | Staebler . | |
| 2,966,041 | 12/1960 | Zearfoss, Jr. et al. . | |
| 3,207,420 | 9/1965 | Navarrete-Kendelan . | |
| 3,676,159 | 7/1972 | Fallowfield | 229/123.1 |
| 3,796,063 | 3/1974 | Wulke et al. | 62/457 |
| 3,865,302 | 2/1975 | Kane | 229/123.1 |
| 3,899,080 | 8/1975 | Brunda . | |
| 3,940,232 | 2/1976 | Stock . | |
| 4,181,285 | 1/1980 | Vangedal-Nielsen . | |
| 4,223,043 | 9/1980 | Johnson . | |
| 4,243,144 | 1/1981 | Margulies . | |
| 4,316,541 | 2/1982 | Braverman et al. | 229/123.1 |
| 4,350,263 | 9/1982 | Hoffman | 229/123.1 |
| 4,478,386 | 10/1984 | Mikkelsen . | |
| 4,487,024 | 12/1984 | Fletcher et al. . | |
| 4,587,810 | 5/1986 | Fletcher . | |

*Primary Examiner*—William E. Topolcai

*Attorney, Agent, or Firm*—Pollock, Vande Sande & Priddy

[57] ABSTRACT

An ice maker employing a relatively thin ice tray with sealed ice cube receptacles and having a freezing chamber of relatively small volume cooled by a high capacity cooling plate. The ice cube receptacles are sealed by a frangible cover to keep liqid water therein and to maintain frozen water in a sanitary state until the frangible cover is ruptured for the ice cubes to be used. The ice maker housing also may include other chambers for holding containers of food and drink. The cooling surface of the freezing chamber may be sloped for drainage and the ice maker provided with a spring loaded device for ejecting the ice tray when a housing door is opened. Detection switches and indicator lights may be actuated by insertion and removal of the tray. Multiple freezing chambers may be jointly cooled by a single cooling plate.

20 Claims, 4 Drawing Sheets

FIG 1
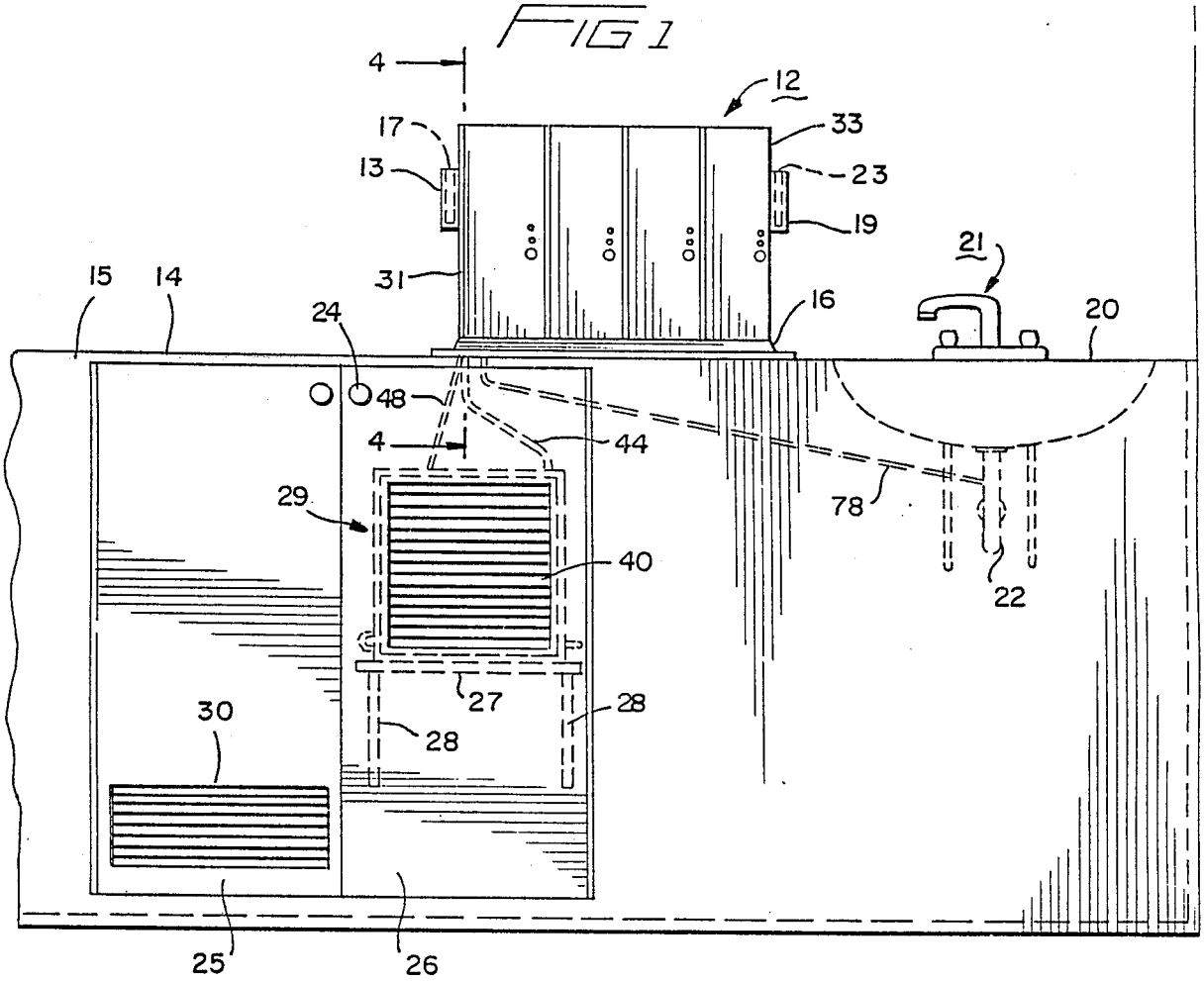
FIG 2
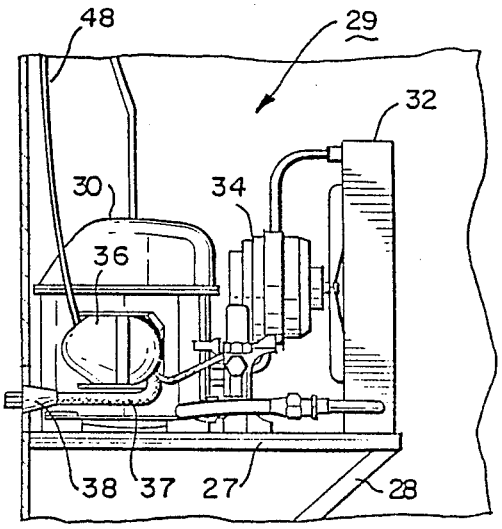
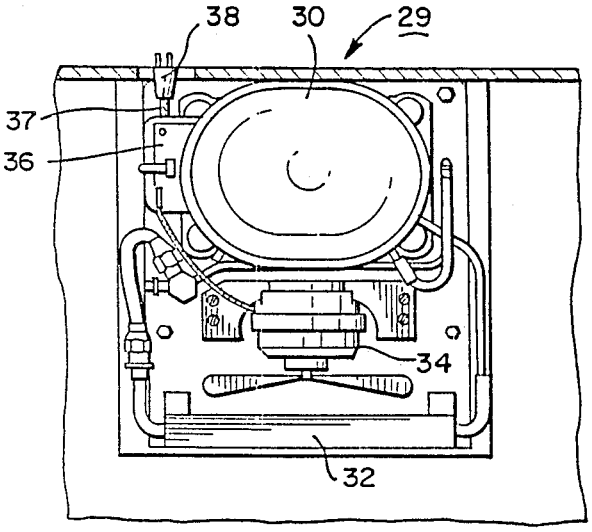
FIG 3

ICE MAKER WITH VERTICAL COOLING MEMBER

This is a division of application Ser. No. 07/095,805, filed Sept. 10, 1987, now U.S. Pat. No. 4,831,840.

TECHNICAL FIELD

The field of this invention relates to ice makers and more particularly to an ice maker of small size for rapidly making ice in a compartmented tray having receptacles for molding a plurality of ice cubes. The receptacles are sealed by a frangible cover for preserving the ice cubes in a sanitary condition.

BACKGROUND OF THE INVENTION

Prior ice making units in general make relatively large amounts of ice, only a portion of which is used at any one time. The unused portion is kept in an accessible storage bin as commonly found in hallways and refreshment areas of hotels, motels and the like. Since only a portion of the accumulated ice is taken out of such storage bins by a succession of users, contamination of the remaining ice may occur through personal contact or distribution of a contaminant during removal of the desired smaller quantity of ice. Such readily accessible bins are often unsecured and easily opened, and therefore there also is a risk of the ice being contaminated by someone intentionally dumping trash or chemicals into the accumulated ice. There is therefore a need for an ice maker of inexpensive construction for providing sanitary batches of ice cubes for use in motel rooms, hotel rooms and the like.

It has been suggested in the past to employ a bag of flexible material for molding liquid water into ice cubes, such as the bags suggested by U.S. Pat. No. 2,964,920 wherein a compartmented mold compresses the flexible walls of a bag into the shape of the ice cubes desired, or the bags suggested by U.S. Pat. No. 4,587,810 wherein the bag is provided with individual compartments and interconnecting passageways by heat welding together two flexible sheets of heat weldable material. The entire contents of both of these patents are incorporated expressly herein by reference. Unfortunately, compartmented molds of the type suggested by U.S. Pat. No. 2,964,920 and compartmented bags of the type suggested by U.S. Pat. No. 4,587,810 provide relatively slow rates of heat transfer and have not found wide utilization.

An ice maker for motel and hotel room applications also needs to be of a compact and durable construction and to have relatively small physical dimensions to facilitate mounting the unit on counters or within cabinets of the type generally found in motel and hotel rooms. Because ice makers of such small dimensions can make only small amounts of ice at one time, an ice maker construction capable of rapidly freezing liquid water is highly desirable.

DISCLOSURE OF THE INVENTION

A principal object of the present invention is to provide a compact ice maker having a sealed, compartmented ice mold for shaping individual ice cubes. A further object is to provide an ice mold comprising a compartmented tray and a frangible cover for preserving the sanitary condition of the ice cubes until they are to be used. Another object of the invention is to provide a relatively strong and rigid tray having separate receptacles in which individual ice cubes may be made and providing this tray with a frangible cover to keep the separate receptacles individually sealed until an ice cube is to be removed from its corresponding receptacle for use. A further object is to provide an ice maker of small size capable of rapidly making and storing in a sanitary condition preselected quantities of ice cubes in locations where space is at a premium and convenience of the user is of prime importance.

The present invention is an improvement over the ice maker described in U.S. Pat. No. 4,587,810. As discussed in this prior patent, one advantage of sealed storage is that the water cannot be contaminated while it is being frozen and stored prior to being dispensed for use as ice in drinks and the like. One advantage of the present invention over that prior invention is that the present invention allows us of conventional refrigeration systems and is capable of freezing more rapidly small quantities of ice in a sealed container. The amount of counter space required for freezing and storing the ice cubes also may be reduced because the conventional refrigeration system may be located elsewhere, such as in a cabinet under the counter.

The present invention provides a compact ice cube maker of such reduced size as to permit its personalized use in offices and in hotels and motel rooms. The ice cubes are made in individual compartments within an ice molding means, which preferably comprises a tray of plastic or metal having receptacles that are sealed by a frangible cover to provide one or more sealed compartments. Preferably, there is a separately sealed compartment corresponding to each receptacle. The sealed compartments insure that the ice cubes remain sanitary until the frangible cover is broken or torn open to dispense the ice cubes for use. Thus, there can be no physical contact with the ice cubes until they have been removed from the compartmented tray for use. So that the sealed tray compartment(s) can be easily opened for removal of the ice, the frangible cover is made of a relatively thin-film material of plastic or metal foil that is easily ruptured by hand. The sealed tray also provides a convenient package for delivering pure water to the ice maker and for carrying the ice cubes from the ice maker to another location at which the ice is to be dispensed for use. Both the frangible cover and portions of the tray between individually sealed compartments may have a series of breakaway perforations so as to separate one or more individual compartments in a sealed condition from the remaining portion of the tray, which may remain in the freezing compartment while the broken-away compartments are removed and opened for use.

The ice making apparatus of the invention comprises at least one ice cube molding means, a cooling member of heat conductive material, cooling means for cooling the cooling member, housing means having an insulated portion defining a freezing chamber and an opening for providing the molding means with access to and from the freezing chamber, and a door member movable between a closed position for covering and an open position for uncovering the chamber opening. The insulated portion of the housing cooperates with the cooling member to define the freezing chamber. The cooling member is preferably a plate having a cooling surface defined substantially by one of its two major sides, and this cooling surface provides at least part of the surface for contacting and supporting the ice tray in the freezing chamber.

The cooling member is arranged to contact the ice molding means and conduct heat away from at least one body of liquid water while it is held therein. The cooling member is cooled by the cooling means so as to rapidly freeze the body of liquid water and form an ice cube therefrom. The cooling means includes a heat exchange means for transferring heat from the cooling member to an internal heat exchange fluid, such as nitrogen, helium or freon, and from this internal fluid to an external fluid, such as air. The cooling means preferably is a conventional refrigeration system of small size and high capacity which includes a compressor, a condenser and an expansion valve in a closed fluid system employing nitrogen as the internal heat exchange fluid. Alternatively, the cooling means may comprise a thermoelectric freezing unit, such as that described in U.S. Pat. No. 4,587,810, or a cryogenic refrigeration unit, such as a model M15-S cryogenic refrigerator available from Cryodynamics, Inc., of Mountainside, New Jersey.

The at least one ice cube molding means comprises the ice tray and the frangible cover. The ice tray has at least one receptacle for receiving and holding the at least one body of liquid water while this body is being frozen to make an ice cube. The frangible cover is adhered to the body of the tray to cover and seal the receptacle(s) after the liquid water is received therein. The frangible cover, the tray receptacle(s), and the means for sealing the cover to the tray provide at least one sealed compartment for the liquid water during the freezing thereof. The cover is frangible so as to be easily broken by hand for removal of the ice cube(s). The tray is made of a resilient material, preferably plastic, and is substantially less fragile than the frangible cover to permit handling without rupture of the tray receptacles.

The individual receptacles of the tray cooperate with the frangible cover to provide one or more ice compartments of a shape selected to yield ice cubes of the desired shape. The sealed ice tray thus serves as an ice cube mold for freezing water in the desired shape and as a storage container for maintaining the sanitary condition of the ice cubes after they are made. Each receptacle of the ice tray preferably has a substantially flat bottom portion which rests on the upper cooling surface of the cooling member. This aids the extraction of heat from each receptacle to rapidly freeze the liquid water previously sealed therein. The cooling surface of the cooling member also forms at least a portion of the bottom wall for supporting the ice tray in the insulated freezing chamber. The cooling means is designed to keep the freezing chamber sufficiently cold that the body of water in each receptacle will freeze rapidly within a relatively short freezing time. The dimensions and materials of the freezing chamber and of the ice tray also are chosen so as to minimize the freezing times.

By the term "bottom wall" or "bottom portion" of the ice tray is meant the overall bottom structure of the tray, even though each ice cube compartment may have a bottom portion separated from the bottom portion of each adjacent compartment by an air gap between spaced apart sidewalls of adjacent compartments. For example, the receptacles of the ice tray may be connected only by top wall portions between the receptacles. Alternatively, the receptacles may be created by divider walls within a larger container volume having a continuous bottom wall connecting all four outer sidewalls of the tray. A segmented bottom wall having separate bottom portions is preferred to allow separation and use of a portion of the ice and continued storage of the unused portion in sealed compartments which may be left in the freezing chamber.

The tray supporting surface of the freezing chamber preferably is slanted downwardly from the chamber opening toward a rear wall of the chamber at an acute angle relative to the horizontal, preferably at an angle of about 2–15 degrees, more preferably about 5–10 degrees, and most preferably about 7 degrees. This slanted supporting surface aids in the drainage of moisture when the cooling member is defrosted by a defrosting cycle of the cooling means. The slanted positioning of the ice tray supporting surface also reduces the horizontal projection of the ice maker housing when it is placed on a counter in a motel or hotel room or is mounted on a wall thereof. Because of the angle of this slant and the shape of the tray receptacles, at least a portion of the liquid water with which the receptacles are filled would spill out of the receptacles if they were not sealed by the frangible cover when the tray is placed in the freezing chamber. Although it is preferable that each receptacle of the tray be individually sealed by the frangible cover to provide entirely separate ice compartments, the frangible cover may be sealed only around the outer edges of the outermost receptacles of the tray so that water may flow between receptacles but not out of the tray when the tray is tilted at the angle of the tray supporting surface. Alternatively, the tray may consist of a single large receptacle without internal dividing walls, so as to make a single ice cube in the shape of a plate having a minor thickness dimension and major width and length dimensions.

The ice molding tray preferably is elongated and in the direction of this elongation has a plurality of longitudinally spaced receptacles each for receiving a corresponding one of a plurality of bodies of water. The longitudinally spaced receptacles preferably are arranged uniformly in a row, and the tray also preferably has a pluralitY of rows of such receptacles in the width direction transverse to the length of the tray. As previously indicated, the frangible cover is preferably arranged to individually seal each of the plurality of receptacles after a corresponding body of water has been received therein, thereby providing separate individually sealed compartments for each of the bodies of liquid water during the freezing thereof. The ice tray is arranged in the freezing chamber with its elongated dimension extending in the direction from the chamber opening toward its rear wall. Each of the tray receptacles preferably includes a substantially flat bottom wall in heat transfer contact with the upper surface of the cooling member.

The ice tray preferably includes a gripping portion at its end opposite to the rear wall of the freezing chamber. The ice maker preferably includes a dispensing means in the freezing chamber for biasing the tray upwardly along the slanted tray supporting surface so as to eject at least the gripping portion of the tray out of the freezing chamber opening when it is uncovered by the door member. The dispensing means may comprise a spring means having a sufficient spring force to push the tray up the slanted supporting surface from a first position with the gripping portion within the freezing chamber to a second position wherein at least the gripping portion of the tray is ejected out of the chamber opening. The spring means may comprise at least one spring, such as a leaf or coil spring. In one embodiment, there may be two or three coil springs each having one end positioned to push against the rear wall of the freezing chamber and an opposite end positioned against the end of the tray opposite to the gripping portion. The ends of the coil springs for pushing against the tray may include a push bar for engaging an opposing end wall of the tray. The ice maker preferably also includes means adjacent to the downward edge of the slanted cooling surface for draining away any liquid water accumulations caused by periodic defrosting of the cooling member.

The insulated portion of the ice maker housing preferably cooperates with a unitary cooling member to define a plurality of freezing chambers each for receiving a corresponding one of a plurality of ice molding means and having an opening for providing the corresponding molding means with access to and from the respective freezing chambers. The unitary cooling member may provide all or part of the supporting surface for supporting each molding means within its corresponding freezing chamber. Where there are a plurality of freezing chambers, the door means preferably includes a plurality of door members each for separately opening and closing a corresponding one of the freezing chambers.

The housing of the ice maker also preferably includes non-insulated chambers for holding packaged foodstuffs at about ambient temperature, such as one chamber for cheese and crackers and one or two chambers for bottles containing a beverage, for example, two mini liquor bottles. Where there are a plurality of freezing chambers, there may be one or more ambient chambers for foodstuffs associated with each freezing chamber. Where there are such foodstuff chambers associated with a freezing chamber, these ambient chambers are preferably opened and closed by the same door means for opening and closing the corresponding freezing chamber.

In an alternative embodiment wherein one or more freezing chambers are combined with foodstuff chambers, the freezing chamber may be located to the rear of the foodstuff chambers and the cooling member arranged along a rear wall of each foodstuff chamber to also remove heat from these chambers. The walls of the foodstuff chambers are preferably insulated and the foodstuff chambers associated with each freezing chamber are opened and closed by a door entirely separate from the door for opening and closing the corresponding freezing chamber. In this embodiment, both the contact surface of the cooling member and the abutting bottom surface(s) of the ice tray are at an angle of substantially 90° relative to the horizontal and substantially the entire weight of the filled ice tray is supported by the ejection means located at the rear of the freezing chamber. In other words, the rear of the freezing chamber is at what could also be designated the bottom of the freezing chamber. With the ice tray in this attitude, the sealed frangible cover clearly is required to keep any significant portion of the bodies of liquid water in their corresponding receptacles of the tray.

The ice maker may include temperature sensing means in at least one of the freezing compartments and control means responsive to this temperature sensing means for operating the cooling means when the temperature in the monitored compartment rises above a preselected temperature setting, preferably at least as low as 32° F., more preferably about 30° F. Where there is a plurality of freezing chambers, a temperature sensing means preferably is provided in each of . the chambers and the control means is responsive to each of these temperature sensing means so as to operate the cooling means if the temperature in any one of the chambers rises above a preselected temperature setting, the preferred values of which are given above. The control means may comprise a thermostat. The control means also may include an electronic defrosting timer mechanism to activate a heating cycle of the cooling means so as to periodically defrost the cooling member. Both the defrosting timer control and the thermostat may be located in individual chambers of corresponding size in the ice maker housing, these chambers being accessible preferably from the rear of the ice maker.

The controls provided for the ice maker also may preferably include deactivating means for detecting the absence of a tray from its corresponding freezing chamber. The control means may be responsive to this deactivating means so as to prevent operation of the cooling means when all of the freezing chambers are empty, there being no need then to continue the cooling cycle of the cooling means. The control system also may include indicator means associated with each of the freezing chambers to indicate the absence or presence of an ice tray within its corresponding chamber. Such an indicator means may provide an electrical signal to activate a light or audible alarm to indicate the tray status. Preferably, signals are provided to alternately activate one or the other of a pair of lights, such as a green light indicating that a tray is present in and a red light indicating that a tray is absent from its corresponding compartment.

The heat removal capacity of the cooling member and the thickness of the receptacles of the ice tray are such that water at ambient temperatures (about 80° F. or less) will freeze in at least about 45 minutes or less, preferably in about 30 minutes or less, and more preferably in about 15 to 20 minutes. Tests have shown that for a relatively shallow tray, namely, an overall ice tray height of preferably about ¾ inch or less, more preferably about ¼ inch to about ⅝ inch and most preferably about ⅝ inch, as measured normal to the cooling surface of the cooling member, the preferred freezing time of about 15 to 20 minutes requires that the cooling member have a heat removal capacity of at least about 7, preferably about 7 to about 12 and more preferably at least about 10, british thermal units (BTU) per day per square inch of the cooling surface of the cooling member. Preferably, the cooling member has fluid conduits or other heat transfer means substantially adjacent to the cooling surface, and a majority of this cooling surface is in contact with the substantially flat bottom portion(s) of the tray. For the preferred freezing time of 15 to 20 minutes, the tray material should be relatively thin (7 to 20 mils of molded plastic material).

Where a spring ejection means is provided for the tray, a resilient seal member may be provided on the door of the freezing chamber. This resilient member preferably includes a projecting portion for resiliently engaging the end of the tray having the gripping portion so as to resiliently oppose the bias of the spring ejection means when the door is closed. The resilient bias provided by the resilient door member thus opposes the force of the spring means and compresses the spring component so that the entire ice tray, including the gripping portion, is held within the freezing chamber when the door is closed. The seal member also seals the access opening into the freezing chamber to keep the cold air contained therein, without significant leakage past the door, either by convection or by conduction.

Although the ice trays and surrounding housing walls may have curved or other odd shapes, the ice maker housing is preferably a rectangular body bounded by six substantially planar walls. The housing walls are preferably of molded plastic material. The bottom wall and lower portion of the front wall of the housing may project out slightly to provide extensions of a base for securing the housing to a countertop or the like. The housing preferably comprises a non-insulated upper section and an insulated lower section. The upper section may have internal walls defining separate chambers for drinks and other foodstuffs and for components of the control system. The lower section preferably includes two panels of insulating material, one above and one below the freezing chamber which is defined therebetween. These insulating panels are preferably molded separately and then are fixed to the upper section by an adhesive or mechanical fasteners to define the freezing chamber. The separate insulating panels may be supported between molded sidewall extensions of the upper section which then define sidewalls of the freezing chamber. The rear wall of the freezing chamber is preferably provided by a rear wall extension molded integrally with the upper section along with the sidewall extensions.

The insulating panels may be made from conventional insulating material. The upper and lower insulating panels preferably comprise a foamed plastic core surrounded by an outer casing or sheet of relatively dense plastic material, such as unfoamed core material or the material from which the upper housing section is made. Preferably, the casing is integrally formed with the core. The upper and lower insulating panels are preferably molded as separate pieces while the entire upper section preferably is molded as an integral unit.

The door members of the housing also are molded separately, preferably from the same material as the upper section of the housing. These door members are then pivotally mounted on the main body of the housing so as to open and close the openings of the freezing chambers and the foodstuff chambers associated therewith. These access doors preferably carry a resilient seal member, preferably of molded synthetic rubber, for engaging the periphery of the freezing chamber opening. A door fastener, latch or lock mechanism with one component on the door and a cooperating component on a face of the housing preferably is used to secure the door member in a firmly closed position wherein the resilient seal member sealingly engages the periphery of the freezing chamber opening. A lock mechanism is preferred so that the door may be locked and unlocked with a key, such as a room key of a motel or hotel room. The key may serve as a handle for opening and closing the door.

The thickness of the insulating panels is preferably at least about ½ inch. Although insulation also may be provided on either side of the freezing chamber, insulation in this position is not essential because of the small height dimension of the freezing chamber as defined by the distance between the upper and lower walls of the freezing chamber. This height preferably is only about ⅛ inch to about 1/16 inch greater than the overall height of the ice tray, including the frangible cover which preferably is made of a metal foil having a thickness of about 6 mils or less, preferably about 3 to about 6 mils.

The upper portion of the housing preferably is molded from a synthetic resin material, such as polyethylene, polypropylene or polyethylene. The lower insulating panels are preferably made of a foamed resin insulating material, such as foamed polystyrene. The tray component of the ice molding means may be molded from the same type of plastic material as the housing, but with a much thinner wall thickness of preferably about 20 mils or less, more preferably about 7 mils to about 15 mils, most preferably about 10 mils. While the plastic of the housing is preferably of a decorative color and may have a decorative design, the plastic of the tray is preferably clear to permit observation of the ice as formed within the tray before the tray is taken out of the freezing chamber for use.

The cooling member is of a heat conductive metal, preferably aluminum, and may comprise two grooved panels of aluminum welded together so that opposing grooves provide a sealed channel for a refrigerant, such as nitrogen. The frangible cover for sealing the tray receptacles is preferably made of a metal foil, such as aluminum, having a preferred thickness of about 3–6 mils, more preferably about 5 mils. The frangible cover is adhered to upper wall portions of the tray by a suitable adhesion means, such as with an adhesive of the same type used in the packaging of condiments such as jellies, jams, syrups, and butter.

The shape selected for the water filled receptacles of the ice tray is one from which frozen ice is readily removable. Subject to this criteria, the individual receptacles may be chosen so as to yield ice cubes of any desired shape. In this specification, "ice cubes" refers to the bodies of ice formed in the tray receptacles regardless of their actual shape, which may be other than cubicle such as a diamond or oval-like shape. When sealed by the frangible cover, the receptacles of the tray serve both as an ice cube mold for freezing a plurality of bodies of water in the desired shapes and as a storage container for maintaining the sanitary condition of the ice cubes after they are made. In other words, after the ice cubes are made, each is stored in its individual compartment within the sealed ice tray and the ice tray is kept sealed to insure that the ice cubes remain sanitary until the frangible cover over one or more of the tray receptacles is torn open so as to dispense ice cubes for use.

Although it is preferred that the frangible cover be adhered to abutting surfaces of the tray so a to provide entirely separate compartments for each ice cube, the frangible cover may be sealingly adhered to the tray only around the outer periphery thereof so as to provide an interconnected series of ice forming compartments. "Interconnected" as used in this specification means that the two volumes of adjacent receptacles remain in fluid communication with each other after the frangible cover is sealingly adhered to the tray. While the cover prevents water spillage from the tray as a whole when it is tilted relative to the horizontal, the water may travel between the interconnected compartments to the extent that they are not already completely filled with water when the tray is level. Such interconnection is not the preferred construction since compartments on the lower side may have more water than compartments on the upper side when such a tray is tilted.

BRIEF DESCRIPTION OF THE DRAWINGS

The invention may be further understood by reference to the description below of the best mode and other specific embodiments thereof taken in conjunction with the accompanying drawings in which:

FIG. 1 is a front elevational view of the invention as installed on a counter near a sink such as in a hotel or motel room.

FIG. 2 is a fragmentary side elevational view of the cooling unit of the invention.

FIG. 3 is a fragmentary plan view of the cooling unit of the invention.

DESCRIPTION OF BEST MODE AND OTHER EMBODIMENTS

Figures 4, 6, 7:
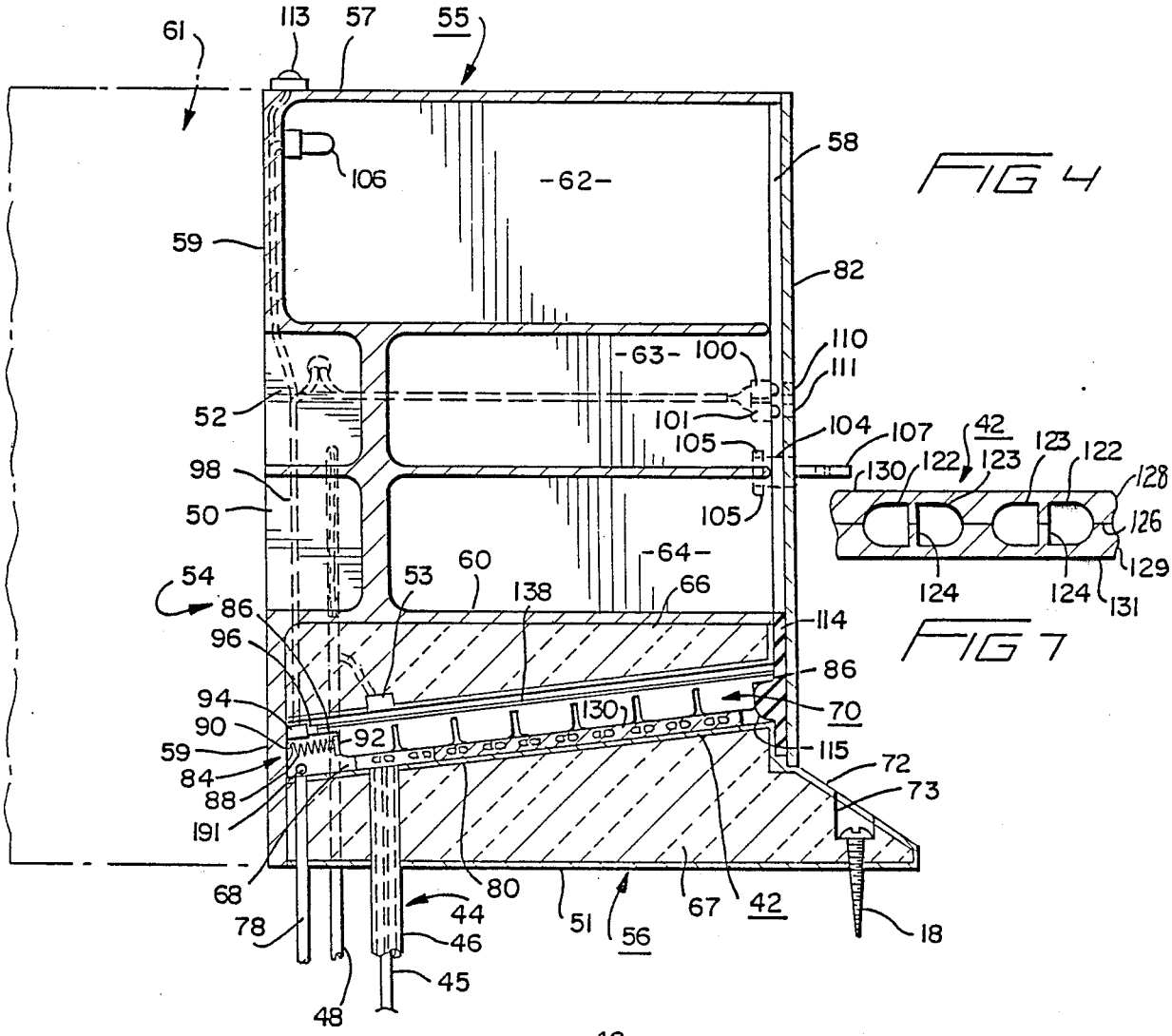
FIG. 4 is a fragmentary side elevational view of the ice making unit of the invention as shown in section taken along lines 4—4 of FIG. 1.
FIG. 6 is a plan view in partial section of the cooling member of the invention.
FIG. 7 is a fragmentary view of the cooling member of the invention as shown in section taken along lines 7—7 of FIG. 6.

Referring to FIG. 1 of the drawings, an ice making unit 12 is mounted on the counter 14 of a supporting cabinet 15. The unit 12 has a base 16 secured to the counter 14 by a plurality of wood screws 18 as seen best FIGS. 4 and 5. Unit 12 is located next to a sink 20 having associated therewith a water fixture 21 and drain 22. Unit 12 may include on one sidewall 31 a pocket-like structure 13 defining a chamber 17 for holding a plurality of party napkins (not shown), and on the other sidewall 33 a pocket-like structure 19 defining a series of cylindrical bores 23 each for holding a stirring rod or swizzle stick (not shown) for stirring a mixed drink.

Below the counter 14, the cabinet structure 15 includes a pair of doors 25 and 26 each having a handle 24. Behind door 26 is an internal shelf 27 supported by a pair of brackets 28—28. Mounted on shelf 27 is a cooling unit 29 comprising a compressor 30, a radiator-type condenser 32, a fan 34, and a fan and compressor control mechanism 36 connected to a conventional 115 volt ac outlet (not shown) by a cord 37 and a three prong plug 38. The cooling unit 29 is preferably a small (for example: 10 inches wide, 11.6 inches deep, and 11 inches high) high capacity refrigeration unit of a conventional design. Such cooling units are available from Tecumseh Products Company of Tecumseh, Michigan 49286, and employ nitrogen as the heat transfer medium (coolant). The compressor is of the hermetic type. The radiator 32 may be replaced by a natural convection heat grid, similar to that on the back of a conventional refrigerator, to eliminate the need for the fan 34, depending upon the heat removal capacity needed for the ice making unit 12.

A louvered vent 40 is provided in door 26 so that air entering the cabinet through an inlet grill 30 in door 25 may be discharged to the room by fan 34 which causes the inlet air to pass through the radiator 32 before being discharged through vent 40. With reference to FIGS. 1 and 4, the cooling unit 29 is connected to a cooling member 42 within the ice making unit 12 by a conduit means 44 which comprises an inlet refrigerant tube 45 and an outlet refrigerant tube 46 concentrically surrounding inlet tube 45. A line 48 of multiple electrical wires connects cooling unit control 36 to a thermostat 50 and a defrosting timer device 52 housed in corresponding chambers of a housing 54 of ice making unit 12. Two of the wires in line 48 are used to connect a temperature sensor 53 mounted in the freezing chamber to thermostat 50.

The housing 54 comprises an upper section 55 and a lower section 56 having a bottom wall 51. Upper section 55 preferably is of a unitary molded construction having a top wall 57, a front wall 58, a rear wall 59, and a lower wall 60. With reference to FIG. 4, top wall 57, bottom wall 51 and sidewalls 31 and 33 may be extended rearwardly to define a chamber 61 behind rear wall 59 for optionally housing cooling unit 29 instead of placing this unit in a separate housing such as that provided by cabinet 15.

Figures 5, 11:
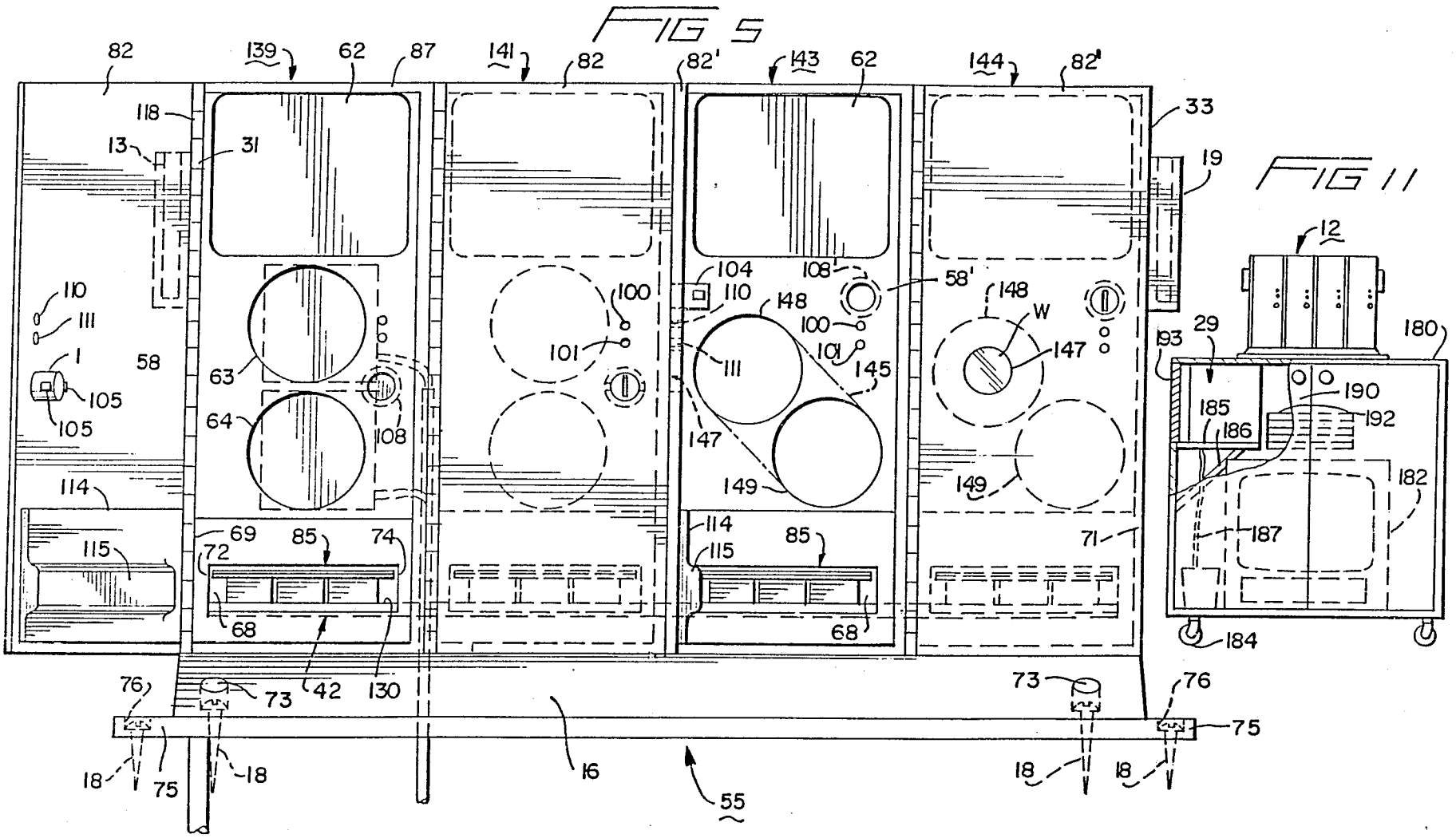
FIG. 5 is a front elevational view of the ice making unit of the invention.
FIG. 11 is a front elevational view in partial section showing a modified mounting arrangement for the invention.

As seen best in FIGS. 4 and 5, internal housing walls are provided to define a food chamber 62 and two mini-bottle chambers 63 and 64. Lower housing section 56 includes an upper insulating panel 66 and a lower insulating panel 67 defining therebetween a freezing chamber 68 for receiving an ice tray 70. The tray 70 is supported on the cooling surface 130, which is defined by the upper, substantially flat major surface of cooling plate 42, so that the bottom wall of tray 70 is in contact with cooling surface 130. The opposite major surface 131 on the lower side of cooling member 42 is supported on upper surface 80 of lower insulating panel 67. Although not shown, lower insulating panel 67 may be molded around cooling member 42 so that upper portions of this panel also may serve as part of the supporting surface for the tray. The rear surfaces of insulating panels 66 and 67 abut a downwardly extending portion of rear wall 59 of upper housing section 55, and side surfaces of insulating panels 66 and 67 abut corresponding sidewall extensions 69 and 71 of upper housing section 55 as seen best in FIG. 5. Some insulating material (not shown) also may be provided adjacent to the sides 72 and 74 of freezing chamber 68.

A portion of the lower insulating panel 67 also provides the base member 16 of the ice making unit and this portion may include a forward projecting ledge 72 having counter sunk holes 73—73 for receiving mounting screws 18—18, and side projecting ledges 75—75 having counter sunk holes 76—76 for additional screws 18—18.

Freezing chamber 68 is provided with a drain tube 78 having its inlet opening located adjacent to the rear of cooling member 42 so that tube 78 may drain away accumulated moisture from periodic defrostings of the cooling member. To cause this moisture to accumulate at the rear of the freezing chamber, the supporting surface 80 of lower insulating panel 67 is slanted. Therefore, cooling member 42 and tray 70 are supported at an acute angle relative to the horizontal. The slope of surface 80 is such that both the bottom of the ice tray and the abutting cooling surface 130 of cooling plate 42 are sloped at an acute angle to the horizontal of preferably at least about 10°-15°, more preferably about 12°. The upper surface of freezing chamber 68 as provided by the lower wall of insulating panel 66 also preferably conforms to this slope so that this upper surface is closely adjacent to the top surface of tray 70. This slanted arrangement of freezing chamber 68 also permits ice tray 70 to be somewhat increased in length without a corresponding increase in the depth of the unit, i.e., the horizontal distance between the front and rear of the ice making unit.

To facilitate removal of tray 70 when a housing door 82 is opened, a biasing means 84 is provided at the rear of chamber 68 to push tray 70 up the slope of the slanted supporting surface so that a gripping ledge or lip 86 of the tray project out of the chamber opening 85 at least about ½ inch, preferably about 1 to 2 inches, when housing door 82 is opened. In other words, biasing means 84 helps dispense ice tray 70 from freezing chamber 68 after the ice cubes have been made. In the embodiment shown, biasing means 84 comprises a pair of coil springs 88 which are compressed between an anchor 90 on rear housing wall 59 and a bar 92 for connecting the outer ends of the springs together and for engaging the adjacent end wall of elongated tray 70. In place of coil springs 88, biasing means 84 may comprise one or more leaf-type springs of flat spring metal, such as a lever anchored at one end or an omega-shaped spring anchored at opposite ends.

Also mounted on the inner side of rear wall 59 is an electrical switch 94 having a spring loaded push button type contact 96 which is arranged to be engaged by the ledge 86 at the end of tray 70 opposite from this same gripping ledge adjacent to chamber opening 85. Switch 94 is connected by an electrical line 98 to a pair of lights 100 and 101 to indicate the presence and absence of ice tray 70 from freezing chamber 68. For example, light 100 may be green in color to indicate the presence of the tray and light 101 may be red in color to indicate the absence of the tray. Line 98 also may be connected through timer control 52 to cooling unit control 36 so as to deactivate the cooling unit when there is no tray in the freezing compartment as indicated by the on condition of red light 101. Indicator means, similar to light 100 and/or light 101 and associated lines and switches, also may be provided to indicate the presence and/or absence of a foodstuff relative to its corresponding chamber.

The control circuit (not shown) supplying electrical power to cooling unit 29 may also include an interlock for preventing actuation of the cooling components until the housing door 82 is in its fully closed position. A further optional provision is to interconnect the thermostat 50 with the lights 100 and 101 by an electrical circuit (not shown) preventing actuation of the green light and cut off of the red light until completion of a freezing cycle initiated by the temperature sensor in the corresponding freezing chamber in which has been placed a new tray containing ambient temperature water to be frozen. The electrical components associated with the controller 36 and interconnected with thermostat 50, timer 52, lights 100 and 101, temperature sensors 53, and detection switches 94 are conventional and therefore are not shown for purposes of simplicity. These components may be housed within the hollow interior of cabinet 14 or cabinet 180, or within recesses of housing 54 similar to those behind the first section containing thermostat 50 and timer 52, but located behind one of the other sections. The power supply preferably is a standard 110–120 volt AC outlet to which the controller 36 is connected by heavy duty electrical cord 37 and plug 38.

In the embodiment shown in FIG. 5, the ice making unit 12 has four (4) separate sections 139, 141, 143, and 144. The first two ice maker sections 139 and 141 toward the left side of housing 55 are shown as being of identical construction, one with door 82 open and the other with door 82 closed. In sections 139 and 141, two separate mini-bottle compartments 62 and 63 and a single food compartment 62 are positioned one above another as illustrated in section in FIG. 4. Although all four sections may be identical for economy of manufacture, the remaining two ice maker sections 143 and 144 toward the right side of housing 55 are shown as being of a different construction to illustrate a modification of the invention wherein the two mini-bottle chambers 63 and 64 are replaced by two separate mini-bottle chambers 148 and 149 positioned at an angle, such as 45°, relative to each other in a front wall 58'. An aperture 147, which may be left open or covered with a transparent material "W", is preferably provided in door 82' to provide visual observation for determining when chamber 148 is empty. The door locking mechanism 104' and corresponding lock engaging annulus 108' have been moved to a position above lights 110 and 111 so as to provide the space needed in the front wall of the housing, for cylindrical chambers 148 and 149, the axes of which lie in a common slanted plane. In FIG. 5, the door 82' of ice making section 143 is open while the door 82' of adjacent ice making section 144 is closed.

In a third embodiment represented by a broken line 145, separate chambers 148 and 149 are replaced by a single slanted chamber of a size sufficient to hold two mini-bottles, one above the other in a slanted stacked arrangement. The plane of symmetry of single slanted chamber 145 is preferably at about a 45° angle relative to the vertical plane of symmetry of the corresponding ice maker section as a whole. With this arrangement, the upper bottle will slide down into the position of the lower bottle when the latter is removed. In this embodiment, aperture 147 may be relocated to a position opposite the lower bottle to indicate when slanted chamber 145 is empty.

The freezing chamber 68 and the food and drink (foodstuff) chambers associated therewith in each of the ice maker sections are all preferably opened and closed by a single door 82 or 82', one for each section. As an alternative, each freezing chamber and each foodstuff chamber could have its own door. Although doors 82 and 82' may be hinged at the bottom, they are preferably mounted by a hinge 118 which connects one side of the door to a corresponding vertically and horizontally extending door frame 87 defined by a front ridge portion of housing 55. Mounted on each door 82 and 82' is a lock mechanism having a lock cylinder 104 and a pair of retractable ears 105—105 for engaging an annular recess 108 or 108' in the front wall 58 or 58', respectively, of housing 54. Lock cylinder 104 has a key slot 110 and is constructed so that a key 107 is retained in the slot as shown in FIG. 4 when the key is turned to place the lock in its open position with ears 105—105 retracted. Thus, the head of the key may serve as a handle to open and close the door. The doors 82 and 82' also may include a pair of apertures 110 and 111 through which lights 100 and 101, respectively, may be observed when the door is closed. An observation aperture, similar to aperture 147, may be provided in door 82 or 82' for any one or more of the chambers 62, 63, 64, 145, 148 and 149, and the corresponding chamber may be illuminated by an interior light actuated by an exterior switch, such as light 106 which is located at the rear of chamber 62 and actuated by switch 113 as shown in FIG. 4.

The raised front ridge forming door frame portion 87 extends slightly forward of front housing wall 58 and all the way around the portion of front wall 58 associated with each freezing chamber 68 and corresponding foodstuff chambers 62–64 positioned thereabove. With reference to FIG. 5, the left side of frame 87 thus serves as a support for door mounting hinge 118 and the remaining three sides of frame 87 serve as a jamb for abutting corresponding inside edges of door 82 when it is closed. Thus, when door 82 is open, front housing wall 58 is in effect recessed relative to door frame 120.

Door 82 carries a seal member 114 for providing an airtight seal for the freezing chamber by engaging the periphery of the chamber opening when the door is closed. Seal member 114 is preferably made of a resilient material, such as synthetic rubber, and preferably has an inwardly projecting boss 115 for engaging the outer edge of tray gripping portion 186 so as to resiliently oppose the bias of springs 88 when door 82 is closed. In the absence of a sealing member 114, the protuberance 115 may comprise a rib-like protuberance of the molded plastic from which the door itself is made and this protuberance may be formed integrally with the remainder of the door. In addition to or in lieu of sealing member 114, door 82 may be provided with edge sealing strips around the inner edges of the door body for engaging the door frame in a manner similar to the sealing strips of a conventional refrigerator door. In the same manner that sealing member 114 provides an air tight seal around the freezing chamber opening, such door strips of conventional design may be used to provide an air tight seal around the entire door frame which would encompass the foodstuff chambers along with the freezing chamber. Instead of separate sealing strips, such strips around the entire door may comprise rib-like extensions of the molded plastic material of the door itself and may be formed integrally with the body of the door.

Referring now to FIGS. 6 and 7, cooling member 42 preferably comprises a pair of serpentine conduits 122 and 123 separated by a dividing wall 124, one serving as an inlet conduit for supplying a liquid refrigerant, such as nitrogen, to the cooling member from condenser 32 and the other for discharging the evaporated refrigerant from the cooling member to compressor 30. Cooling member 42 may be made by welding together along a weld line 126 two (2) plates 128 and 129 having opposing grooves that form conduits 122 and 123 when the grooved faces of these plates are in the abutting relationship shown in FIG. 7. The thickness of the crosssection shown in FIG. 7 has been enlarged for clarity whereas cooling member 42 is actually very thin, having a thickness of preferably about 1/16 to ⅛ inch, more preferably about 3/32 inch. Cooling member 42 also may be made by molding an aluminum plate around a flat tubular structure laid out in the serpentine pattern of FIG. 6 and comprising two concentric tubes of copper similar to the refrigerant supply and return lines 45 and 46 previously described, but flattened into thin oval cross-sections.

Figure 8:
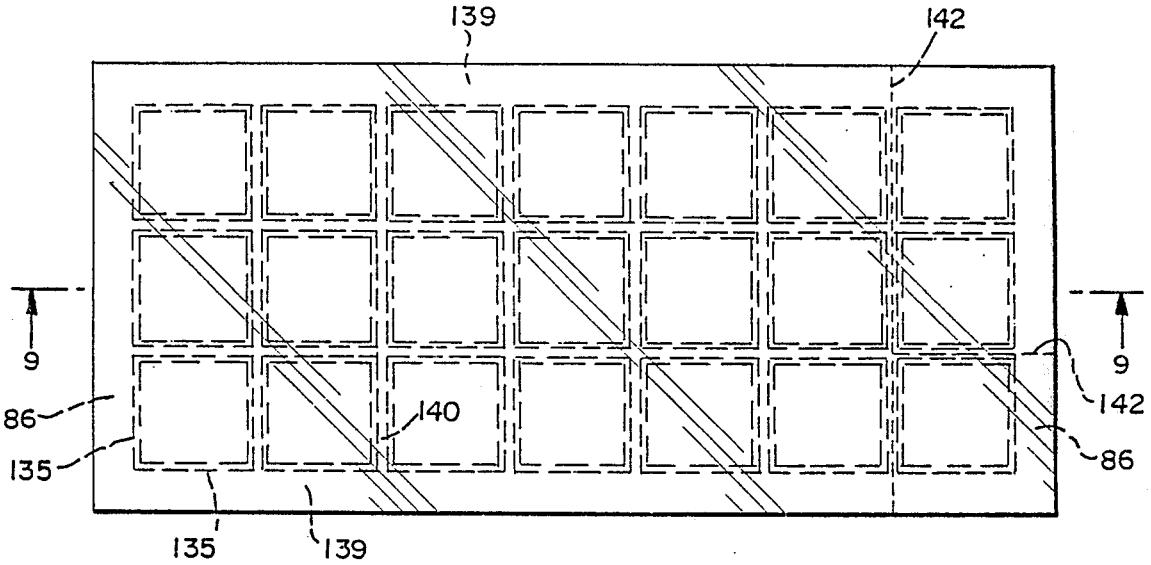
FIG. 8 is a plan view of the sealed ice molding tray of the invention.
Figure 9:
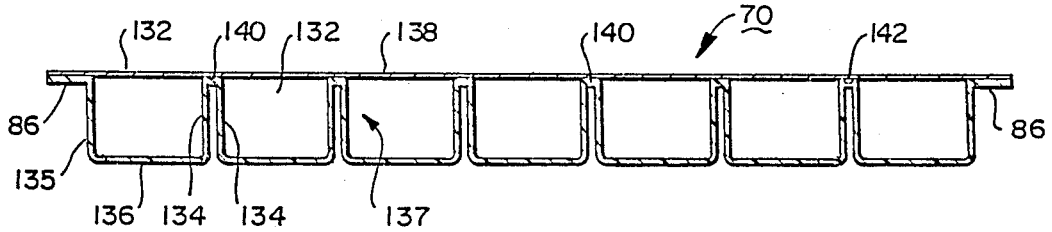
FIG. 9 is a side elevational view of the sealed ice molding tray of the invention as shown in section taken along lines 9—9 of FIG. 8.

As seen best in FIGS. 8 and 9, the ice tray 70 has a plurality of individual receptacles 132 each for receiving a body of liquid water and holding this body in the desired shape while it is converted to an ice cube of corresponding shape. In the embodiment shown, adjacent receptacles 132—132 are separated from each other by a pair of sidewalls 134—134, one associated with each of these separate receptacles. The outermost receptacles around the periphery of the tray each have at least one outside wall 135, the receptacles at each corner of the tray having two such outside walls. Each receptacle also has a separate bottom wall portion 136 that is substantially flat so that substantially all of the composite bottom wall of the tray will contact the upper cooling surface of cooling member 42. As an alternative that is not shown, the bottom wall of tray 70 may extend continuously between opposing continuous outside walls and the individual ice receptacles may be provided by an internal divider having solid partitioning walls in place of dual opposing walls 134—134.

The ice tray 70 is provided with a frangible cover 138, preferably of aluminum foil, which is adhered by a layer of adhesion to the upper surfaces of gripping ledges 86 at each end and side ledges 139—139, and to the upper surface of a connecting wall portion 140 connecting all adjacent receptacles 132—132. Ledges 86—86 and 139—139 form an overhanging lip that extends around the entire upper periphery of the tray. The layer of adhesion preferably extends completely around the upper surface of the periphery of each receptacle so as to provide a plurality of individually sealed ice tray compartments 137. The adhesive preferably used for this purpose may be the same as that conventionally used in making small individual packages of jelly, syrup, butter, and the like. As illustrated best in FIG. 8, bottom wall 136 of tray 70 is relatively thin, preferably about 7 to about 15 mils, more preferably about 10 mils, to provide good heat transfer between a body of liquid water in receptacle 132 and the cooling surface 130 of cooling plate 42.

One or more of the upper interconnecting wall portions 140 may have tear lines 142—142 formed by linear indentations providing a tear line of reduced wall thickness so that one or more individually sealed ice receptacles may be easily separated from the remaining package. In other words, the connecting wall portion 140 and the abutting part of frangible cover 138 may be easily torn along tear lines 142—142. In lieu of a wall thinning indentation, a line of perforations (not shown) may be provided through both connecting wall portion 140 and the abutting part of frangible cover 138. Only two tear line segments 142—142 have been shown in FIG. 8 for purposes of clarity. Such tear lines may be provided between all longitudinal rows of ice cube compartments and between the adjacent compartments in each row. Due to these tear lines, a single ice cube compartment or two or more adjacent ice cube compartments may be torn away without rupturing the remaining ice tray package. Thus, only the amount of ice needed at any given time can be removed from the sealed ice molding structure without contaminating the remaining ice cubes which may be returned to the freezing compartment of the ice maker for future use.

Figure 10:
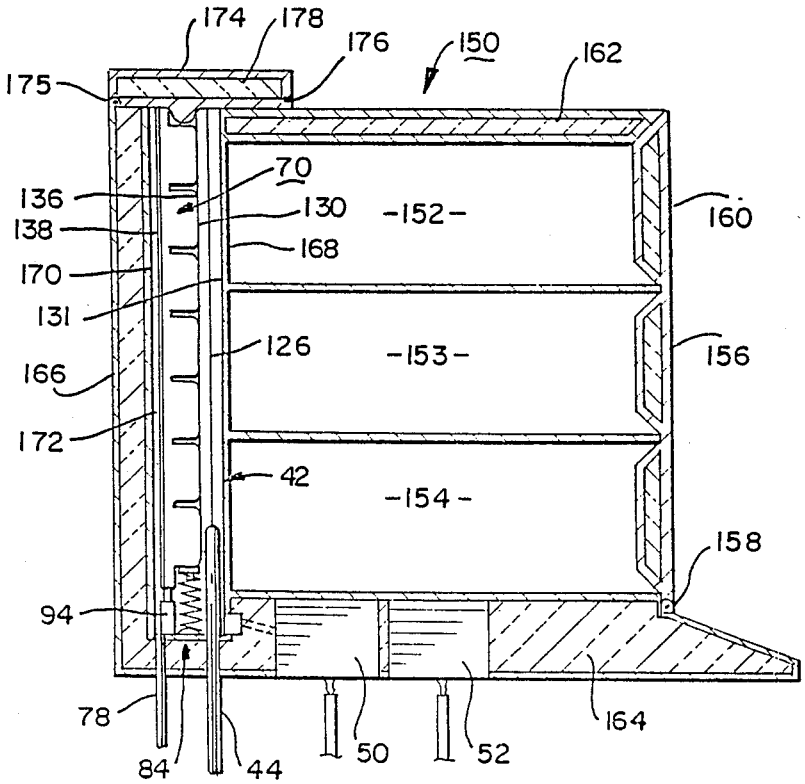
FIG. 10 is a side elevational view in section of a modified embodiment of the ice making unit of the invention.

FIG. 10 illustrates an embodiment of the invention wherein an ice maker housing 150 defines three foodstuff chambers 152, 153 and 154 of substantially the same size for either food or drinks. The access openings of all three chambers are closed by a single door 156 mounted for pivotal opening and closing movement by a bottom hinge 158. Door 156 includes a plurality of foam core insulating panels 160, one for each chamber opening. Housing 150 further comprises a top panel 162, a bottom panel 164, and rear panel 166, each having an insulating core, preferably of foam plastic. The sidewalls of housing 150 also comprise insulating panels (not shown). Thus, all exterior walls of housing 150 are insulated because the foodstuff chambers 152, 153 and 154 are cooled along with freezing chamber 155.

In the embodiment of FIG. 10, bottom surface 131 of cooling member 42 abuts against a rear wall 168 common to all three chambers 152, 153 and 154 so that operation of the cooling unit 29 will also provide significant heat removal from these chambers and thereby cool any food and drink items contained therein. The thickness and material of rear wall 168 and the heat removal capacity of cooling member 42 are preferably such that the temperatures maintained in the food and drink chambers always remain above the temperature at which water freezes, namely 32° F., and below a maximum of about 50° F.

As shown in FIG. 10, the ice tray 70 is supported at one end by a portion of insulated bottom panel 164 and is held in a substantially vertical position by the rear insulating panel 166 and cooling member 42. The inner surface 170 of panel 166 is closely adjacent to or in contact with frangible cover 138 of tray 70, and cooling surface 130 of plate 42 is closely adjacent to or in contact with bottom 136 of ice tray 70. Inner wall surface 170, cooling surface 130, and the supporting part of bottom housing panel 164 define a freezing chamber 172 extending vertically and horizontally over the rear portion of housing 150 opposite the rear ends of chambers 152, 153 and 154. An access opening at the upper end of chamber 172 is closed by a separate door member 174 pivotally hinged at 175. Because of the position of freezing chamber 172, freezing chamber door 174 is entirely separate from the door 156 for the foodstuff chambers. Door 174 preferably includes a seal member 176 and, as with the other insulating parts of the housing, has a foam insulating core 178. The components common to the different embodiments of FIGS. 4 and 10 bear the same numerical designations and are not described further here because they have already been described above.

Referring now to FIG. 11, there is shown a modification of the invention in which the ice making unit 12, having either housing 55 or housing 150, is mounted on a cabinet 180 of an entertainment center containing a television set 182 and possibly other entertainment devices such as a stereo system (not shown). The cabinet 180 may be mounted on four casters 184 (only two of which are shown) for ease of movement within a hotel or motel room. The cooling unit 29 may be mounted within the cabinet 180 on a shelf 185 supported by a bracket 186. The cooling unit 29 and the television set 182, and any other entertainment devices, may have a common source of 110–120 volt AC electrical power (not shown). Accumulated moisture from defrosting of the ice maker may be conveyed by a flexible drain line 187 to a portable container 188 which may be removed for emptying into a sink or the like by opening the left hand cabinet door 190. Ventilation for the condenser of cooling unit 29 may be provided by an air inlet 192 and a louvered air outlet 193. The cabinet 180 may be of wood or metal having a decorative exterior design or finish. Exterior surfaces of the ice maker housing may have a similar decorative design or finish or a contrasting design or finish compatible with that of cabinet 180.

The location of the cooling unit 29 in a separate cabinet 15 of 180 having access doors provides easy access for maintenance of the cooling unit components. The thermostat 50 and the defrosting timer 52 also are easily accessible in their corresponding chambers, which are accessible from the rear of housing 55 and from the bottom of housing 150. It is preferable to removably fasten the lower housing panel 67 to the cabinet top by screws or the like so as to provide easy access for maintenance of the components of the ice making unit 12. Lower insulating panels 66 and 67 of housing 55 also may be fastened to the walls of upper housing portion 54 by screws or the like (not shown) to provide access for maintenance of the cooling plate 42, the biasing means 84, the detection means 94, and the temperature sensor 53.

As illustrated in FIGS. 1 and 5, the ice making unit 12 may comprise four separate freezing chambers and ice trays, each with an associated food chamber and an associated chamber or chambers for at least two minibottle drinks. Each of these sections may have its own cooling member so as to be independent of the others. However, multiple ice making and food storage sections permit a desirable consolidation of components. Thus, in the preferred embodiment shown, the unitary cooling member 42 extends substantially across the width of housing 55 from one sidewall to the other so that a single cooling plate is used to cool all four freezing chambers and to support each of the four ice trays in its corresponding freezing chamber. While a separate temperature sensor 53 preferably is provided in each of the four freezing chambers, the four sensors may be connected to a single thermostat 50, and the defrosting cycle of the cooling unit is controlled by a single timer mechanism 52. A horizontally extending drain conduit 191 connects the rear bottom volume of each freezing chamber to the next adjacent freezing chamber so that accumulated moisture in all of the freezing chambers is drained from housing 55 by a single drain line 78 or 187. Similarly, multiple sections (not shown) of housing 150 may be drained by a single drain line. Accordingly, there may be a plurality of separate ice making and food storage sections in the ice maker housing, the number of sections depending merely upon the amount of ice, food and drink desired at the location selected and the amount of counter space available for the ice maker at that location.

Where a plurality of ice making and food and drink storage sections are provided, it is preferable to electrically interconnect the plurality of tray detecting switches 94 with the cooling unit control 36 so that the cooling unit is deactivated when all of the switches, one corresponding to each chamber, are simultaneously activated by the absence of ice trays from all of the freezing chambers. This will result in a substantial saving in electrical power when all of the freezing chambers are empty. It is also preferable to provide a temperature sensor 53 in each freezing chamber and to electrically interconnect these temperature sensors with the thermostat 50 so that the cooling unit will be activated in the event that any one of the multiple freezing chambers rises above the preselected maximum temperature setting, and will be deactivated only when all of the freezing chambers are lowered below the preselected minimum temperature setting. In this regard, the circuitry for the tray detection switches 94 may be interconnected with the circuitry for the temperature sensors 53 so that the cooling unit will not be activated by set point temperatures in a freezing chamber from which the corresponding ice tray is absent.

Thermostat 50 is preferably set so as to activate a freezing cycle at a preselected temperature preferably in the range of about 32° F. to about 34° F., and to deactivate this freezing cycle when the freezing chamber temperature is lowered into the range of about 20° F. to about 30° F., preferably about 22° F. to about 26° F., and more preferably about 25° F. Thereafter, . the thermostat 50 in cooperation with the controller 36 converts the cooling unit to intermittent cooling operation in which the compressor 30 and fan 34 are turned on at a temperature in the range of preferably about 30° F. to about 31° F. and turned off when the freezing chamber temperature is lowered to preferably about 26° F. to about 27° F. Where there are multiple freezing chambers, the controller is set for both activating and deactivating both the freezing cycle and subsequent cooling cycles in response to the highest temperature measured in any compartment. For example, the first compartment to reach 32° F. will activate the freezing cycle and the last compartment to reach about 25° F. will deactivate the freezing cycle.

The configurations of the sealed ice tray, the cooling plate and the freezing chamber, and the heat removal capacity of the cooling unit are selected so that the time required to convert the bodies of liquid water in the tray receptacles to ice is minimized. With an ambient water temperature of about 80° F. or less, these parameters are preferably selected so that the time required for the ice maker to freeze a new batch of ice is not more than about 45 minutes, preferably not more than about 30 minutes, and most preferably not more than about 20 minutes. By configuration of the ice tray is meant the heat conductivity of the material from which it is made, the wall thickness of its substantially flat bottom portion(s) in contact with the cooling member, and the thickness of the bodies of water held in the tray receptacles as measured perpendicular to the substantially flat bottom portion(s). By configuration of the cooling member is meant the heat conductivity of the material from which it is made, the arrangement of its cooling surface to contact substantially all of the bottom portion(s) of the ice tray and the arrangement and size of its cooling passages relative to its contact surface. By configuration of the freezing chamber is meant its low volume in excess of the volume occupied by the ice tray, the excess volume preferably being less than about 15%, more preferably less than about 10%.

The heat removal capacity of the cooling unit includes the rate of heat transfer from the cooling surface of the cooling plate member to the cooling medium flowing through the coolant channels of this plate. The horizontally extending upper contact surface of the cooling plate preferably is in direct thermal communication with the heat exchange fluid flowing in the internal channels of the cooling member. The heat transfer fluid is supplied either continuously or intermittently to the cooling member in a direction that causes heat to be absorbed from the cooling member and released to the environment at the radiator component of the cooling unit. For an ice tray height in the range of about ¼ to about ¾ inch, preferably about ⅜ to about ⅝ inch, the heat removal capacities of the cooling member and cooling unit are such that heat is extracted from the freezing chamber at a rate of at least about 7, preferably about 7 to about 12 and most preferably at least about 10, BTU's per day per square inch of cooling surface 130.

It is contemplated that the ice tray 70 will be supplied to hotels and motels using the ice maker as a prepackaged container with liquid water in the sealed compartments formed by the tray receptacles 132 and the frangible cover 138. When the ice cubes from a previously frozen tray have been used up, the old tray is disposed of and a new sealed tray is inserted in each empty freezing chamber of the ice maker.

This will commence activation of a freezing cycle because the ambient water in the tray will raise the temperature of the freezing compartment receiving the new tray above the 32° F. set point previously described. Alternatively, commencement of the freezing cycle may be initiated by a switch (not shown) actuated by closure of the door, or by a manual switch on an external surface of the ice maker, or by insertion of a key in the lock 104. The initial activating switch could also be coin operated so that it is actuated in response to insertion of a coin in a coin slot of the switch.

When the water in the newly inserted ice tray has frozen, the amount of electrical energy used in keeping the ice frozen is reduced by the use of thermostat 50 and its associated electrical circuit (not shown) to cycle the cooling unit 29 on and off. When ice is desired, the door of the ice maker is opened using a key, which when turned may serve as a handle for the door, and the ice tray is removed. The removed ice tray subsequently may be torn apart so as to expose only the number of ice cubes desired for immediately use and the remaining portion of the tray may be returned to the freezing chamber to keep the ice frozen. If the entire tray is used, a new tray is obtained from a nearby source of supply, such as a dispensing rack mounted on an exterior surface of the ice maker housing or on an adjacent wall or in a central location such as a hallway. The filling of empty freezing compartments with a new tray may be accomplished either by the current occupant of the room, by cleaning service personnel, or by a subsequent occupant of the room or other area in which the ice maker is installed.

During the time that current is supplied to compressor 30 and fan 34 by the controller 36, the fan operates to force air past the radiator 32 which serves as a condenser to liquify the compressed cooling medium. Cool ambient air enters air inlet grill 30 or 192 and then flows through the radiator 32 and out of the cabinet 14 through air outlet grill 40 or out of cabinet 180 through air outlet grill 193. During the ice freezing cycle, fan 34 may operate continuously to provide forced air convection for rapid cooling and freezing of water held within the individual compartments of ice tray 70. Upon completion of the freezing cycle as detected by the thermostat 50, compressor 30 and fan 34 are preferably operated intermittently thereafter to keep the previously made ice in its frozen condition. As previously described, continuous operation of the heat removing components of the ice maker in their freezing mode is capable of rapidly providing a new supply of ice within 40 minutes, preferably 30 minutes, and more preferably 20 minutes. In fact, the heat removal efficiency of the preferred constructions of the invention may be sufficiently high that rapid freezing of the compartmented water can be achieved with a natural convention radiator or grid such that fan 34 may be eliminated.

In a particularly preferred embodiment of the invention described by way of example, the ice maker housing (exclusive of the base) is 10 ½ inches high by 15 ½ inches wide by 7 inches deep. The forward extension of the base 16 beyond this main portion of the housing is 1 ¾ inches and the side extensions of the base 16 are 1 inch on either side. Both the forward extension and the side extensions are optional since separate securing brackets may be used instead. The dimensions of each freezing chamber 68 are 11/16 inch high by 3 inches wide by 7 inches deep. The overall height of the insulated lower housing section 56, including the height of the freezing chamber, is about 3 inches, with the minimum thickness of insulating panels 66 and 67 being at least about ½ inch, preferably about ⅝ inch. The diameter of each mini-bottle chamber is about 2 inches for a depth of about 5 inches. The dimensions of the food compartment 62 are a height of about 3 inches by about 7 inches wide by about 7 inches deep. The minimum thickness of the bottom wall 60 of the upper housing section 55 and the divider walls between the food and drink storage chambers is about ⅛ inch.

The ice tray is preferably molded from plastic material to provide wall thicknesses of about 20 mils or less, preferably about 7 to about 15 mils, more preferably about 10 mils. The thickness of the frangible cover 138 of aluminum foil is about 3–6 mils, preferably about 5 mils. The length of the tray in its elongated direction is preferably about 6 ⅛ inches as measured from the outer edge of one gripping lip 86 to the outer edge of the opposite gripping lip 86. The tray is about 2 ⅞ inches wide as measured from the outer edge of the lips 139—139 running along each side. Each of the lips has a transverse width of about ¼ inch and about the same thickness as the tray walls. The overall height of the ice tray including the frangible cover is a maximum of about ¾ inch, preferably about ¼ inch to about ⅝ inch, more preferably about ⅝ inch. Due to the thicknesses of the tray bottom and the foil cover and the necessity of a small air space above the liquid water when it is sealed in each receptacle, the thickness of the ice cubes may be about 1/32 inch (about 30 mils) less than the overall height of the tray, although the ice thickness and the tray height are often about the same because the foil cover may flex upward slightly (by about 20–30 mils) as the water freezes. The planar shape of the ice cubes is a square measuring about ¾ inch on each side. The thickness of the bottom and side walls of each receptacle is preferably about 15 mils and the thickness of the metal foil is preferably about 4–5 mils. An ice tray of these dimensions having three rows of seven receptacles each will hold about two ounces as the total weight of water.

A freezer plate type cooling member made of molded aluminum surrounding concentric copper tubing may have overall dimensions of 9 ½ inches wide by 5 ½ inches deep by ⅛ inch thick. The cooling unit for supplying nitrogen refrigerant to this cooling plate may be a compressor and condenser of the hermetic type available from Tecumseh Products Company of Tecumseh, Michigan. The rated capacity of one unit for the foregoing freezer plate may be about 800 BTU's in 24 hours, such that the freezer plate provides a heat removal capacity per freezing chamber of about 200 BTU's per 24 hours. This heat removal capacity is equivalent to about 10 BTU's per day per square inch of the cooling surface area on the upper side of the freezer plate, portions of which contact each ice tray in a corresponding freezing chamber. This heat removal capacity is sufficient to freeze ambient temperature water (80° F. or less) in the sealed ice tray described in the freezing chamber described within a maximum time of about 20 minutes.

INDUSTRIAL APPLICABILITY

The invention provides a compact ice cube maker of such reduced size as to permit personalized use in hotel and motel rooms and in an office environment. An ice maker of such small size also may be used in boats, airplanes, trucks, cars, trailers and other vehicles. The water from which the ice is made and the resulting ice cubes are sealed within a tray covered by a frangible cover so that the ice cubes remain in a sanitary condition until the cover is ruptured to dispense the ice cubes for use. The ice tray, the cooling plate, the insulated freezing chamber and the cooling unit cooperate in a manner that insures efficient pumping of heat from the bodies of water in the tray receptacles to a heat exchange fluid flowing through the cooling plate, and from this fluid to ambient air flowing past a heat exchanging component of the cooling unit. Rapid heat removal from the water in the ice tray is facilitated by the relatively small thickness of the tray, by the relatively high ratio of tray volume to the volume of the freezing chamber, and by the relatively small thickness and mass of the cooling plate through which the refrigerant flows at a relatively high flow rate to provide a correspondingly high heat transfer rate. The ice maker does not require any water pipe connections and uses a standard electrical wall outlet.

What is claimed is:

1. An ice making apparatus comprising:

at least one ice cube molding means for holding a plurality of bodies of liquid water while said bodies are being frozen to make ice cubes;

a cooling member of heat conductive material for cooling said molding means and causing heat to be conducted away from said bodies of liquid water;

cooling means for cooling said cooling memmber so as to freeze said bodies of liquid water and form ice cubes in said molding means, said cooling means including a heat exchange means for transferring heat from said cooling member to a heat exchange medium;

housing means including an insulated portion cooperating with said cooling member to define at least one insulated freezing chamber for receiving said at least one molding means and having an opening for providing access to and from said freezing chamber, said cooling member having a substantially vertical cooling surface positioned to cool said freezing chamber;

door means including an insulated door member movable between a closed position for covering and an open position for uncovering said freezing chamber opening; and, dispensing means for biasing said molding means upwardly along said cooling surface so as to eject out of said freezing chamber at least a gripping portion of said molding means when said freezing chamber opening is uncovered by said door member,

2. The apparatus of claim 1 in which said door means includes resilient means for opposing the bias of said dispensing means when said door means covers said freezing chamber opening.

3. The apparatus of claim 1 in which the heat removal capacity of said cooling means is at least about 10 British Thermal Units per day per square inch of the cooling surface of said cooling member, and this thickness of each of said bodies of liquid water normal to the cooling surface of said cooling member is such that substantially the entire mass of each of said bodies of liquid water is converted to ice in about thirty (30) minutes or less when the ambient temperature of said bodies of water is about 80° F. or less.

4. The apparatus of claim 62 in which said common wall comprises at least a portion of said cooling member positioned to cool said nonfreezing chamber to a temperature below ambient temperature.

5. The apparatus of claim 4 in which said common wall is substantially vertical and provides a side wall of said nonfreezing chamber and one of two major walls of said freezing chamber.

6. The apparatus of claim 1 in which said housing means further defines at least one nonfreezing chamber isolated from and having a common wall with said freezing chamber, said nonfreezing chamber being of a size and shape to hold a food or drink package and having an opening for providing said package with access to and from said nonfreezing chamber, and said cooling member having a second cooling surface positioned to cool said nonfreezing chamber when said cooling means is operated to cool said freezing chamber.

7. The apparatus of claim 6 in which said housing means further defines at least one other nonfreezing chamber corresponding to said freezing chamber, said other nonfreezing chamber being of a size and shape to hold a second food or drink package and having an opening for providing said second package with access to and from said other nonfreezing chamber, said first package opening and said second package opening being opened and closed simultaneously by a common door means.

8. The apparatus of claim 7 in which said cooling member is positioned to cool both of said nonfreezing chambers when said cooling means is operated to cool said freezing chamber.

9. The apparatus of claim 6 in which said nonfreezing chamber is elongated in width along an axis extending at an angle relative to a horizontal plane, the amount of said elongation being sufficient for said nonfreezing chamber to receive at least two foodstuff packages one above the other, and in which said nonfreezing chamber is provided with a door means having a window means allowing visual observation of the lowest of said packages through said nonfreezing chamber door means when said nonfreezing chamber is covered by said nonfreezing chamber door means.

10. The apparatus of claim 6 further comprising temperature sensing means in at least one of said compartments and control means responsive to said temperature sensing means for operating said cooling means when the temperature in said at least one compartment rises above a preselected temperature setting.

11. The apparatus of claim 10 in which a temperature sensing means is provided in each of said compartments and said control means is responsive to said temperature sensing means to operate said cooling means if the temperature in any one of said compartments rises above a corresponding temperature setting preselected for each of said compartments.

12. The apparatus of claim 1 in which said molding means comprises a tray having length and width dimensions substantially greater than its thickness dimension, said freezing chamber has two major walls each with dimensions corresponding to the length and width dimensions of said tray, and the length and width dimensions of said tray are substantially parallel to said cooling surface when said tray is in said freezing chamber.

13. The apparatus of claim 1 in which said ice cube molding means comprising a tray having a plurality of receptacles each for receiving a corresponding one of said plurality of bodies of liquid water, a frangible cover for covering said plurality of receptacles with said bodies of liquid water received therein, and means for adhering said frangible cover said tray so as to provide at least one sealed compartment for said bodies of liquid water during said freezing thereof, said frangible cover being rupturable by hand, and said tray being substantially less fragile than said frangible cover so as not to be ruptured when said frangible cover is ruptured by hand.

14. The apparatus of claim 1 which further comprises deactivating means for detecting the presence of said molding means in said freezing chamber, and control means responsive to said deactivation means to prevent operation of said cooling means when said freezing chamber is empty.

15. The apparatus of claim 1 which further comprises means adjacent to a downward edge of said cooling surface for draining any liquid water accumulations caused by a defrosting of said cooling member or leakage from said molding means.

16. An ice making apparatus comprising:

at least one ice cube molding means for holding at least one body of liquid water while said body is being frozen to make an ice cube;

a cooling member of heat conductive material for cooling said molding means and causing heat to be conducted away from said body of liquid water;

cooling means for cooling said cooling member so as to freeze said body of liquid water and form an ice cube in said molding means, said cooling means including a heat exchange means for transferring heat from said cooling member to a heat exchange medium;

housing means including an insulated portion cooperating with said cooling member to define at least one insulated freezing chamber for receiving said at least one molding means and having an opening for providing access to and from said freezing chamber, said cooling member having a substantially vertical cooling surface positioned to cool said freezing chamber;

door means including a door member movable between a closed position for covering and an open position for uncovering said freezing chamber opening; and, deactivating means for detecting the presence of said tray in said freezing chamber, and control means responsive to said deactivation means to prevent operation of said cooling means when said freezing chamber is empty.

17. The apparatus of claim 16 which further comprises means adjacent to a downward edge of said cooling surface for draining any liquid water accumulations caused by a defrosting of said cooling member or leakage from said molding means.

18. The apparatus of claim 16 in which said ice cube molding means comprising a tray having at least one receptacle for receiving said at least one body of liquid water, a frangible cover for covering said receptacle with said body of liquid water received therein, and means for adhering said frangible cover to said tray so as to seal said receptacle and provide a sealed compartment for said body of liquid water during said freezing thereof, said frangible cover being rupturable by hand, and said tray being substantially less fragile than said frangible cover so as not to be ruptured when said frangible cover is ruptured by hand.

19. An ice making apparatus comprising:

at least one ice cube molding means for holding at least one body of liquid water while said body is being frozen to make an ice cube;

a cooling member of heat conductive material for cooling said molding means and causing heat to be conducted away from said body of liquid water;

cooling means for cooling said cooling member so as to freeze said body of liquid water and form an ice cube in said molding means, said cooling means including a heat exchange means for transferring heat from said cooling member to a heat exchange medium;

housing means including an insulated portion cooperating with said cooling member to define at least one insulated freezing chamber for receiving said at least one molding means and having an opening for providing access to and from said freezing chamber, said cooling member having a substantially vertical cooling surface positioned to cool said freezing chamber;

means adjacent to a downward edge of said cooling surface for draining any liquid water accumulations caused by a defrosting of said cooling member or leakage from said molding means; and, door means including a door member movable between a closed position for covering and an open position for uncovering said chamber opening;

said ice cube molding means comprising a tray having at least one receptacle for receiving said at least one body of liquid water, a frangible cover for covering said receptacle with said body of liquid water received therein, and means for adhering said frangible cover to said tray so as to seal said receptacle and provide a sealed compartment for said body of liquid water during said freezing thereof, said frangible cover being rupturable by hand, and said tray being substantially less fragile than said frangible cover so as not to be ruptured when said frangible cover is ruptured by hand.

20. The apparatus of claim 19 further comprising deactivating means for detecting the presence of said tray in said freezing chamber, and control means responsive to said deactivation means to prevent operation of said cooling means when said freezing chamber is empty.

* * * * *

UNITED STATES PATENT AND TRADEMARK OFFICE

CERTIFICATE OF CORRECTION

PATENT NO. : 4,916,921

DATED : April 17, 1990

INVENTOR(S) : Charles J. Fletcher

It is certified that error appears in the above-identified patent and that said Letters Patent is hereby corrected as shown below:

Column 20, line 36, change "memmber" to --member--.

Column 21, line 6, change "62" to --6--.

Column 22, line 9, after "cover" insert --of--.

Column 20, line 67, change "this" to --the--.

Signed and Sealed this

Thirtieth Day of July, 1991

*Attest:*

HARRY F. MANBECK, JR.

*Attesting Officer*

*Commissioner of Patents and Trademarks*